US006814403B2

(12) United States Patent
Zheng

(10) Patent No.: US 6,814,403 B2
(45) Date of Patent: Nov. 9, 2004

(54) MULTI-POSITION COLLAPSIBLE BEACH CHAIR WITH SOLID ARMRESTS

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/469,924

(22) PCT Filed: Mar. 2, 2001

(86) PCT No.: PCT/US01/07821

§ 371 (c)(1),
(2), (4) Date: Feb. 9, 2004

(87) PCT Pub. No.: WO02/069760

PCT Pub. Date: Sep. 12, 2002

(65) Prior Publication Data

US 2004/0135405 A1 Jul. 15, 2004

(51) Int. Cl.[7] ..... A47C 4/00

(52) U.S. Cl. ..... 297/42; 297/16.2; 297/35; 297/45

(58) Field of Search ..... 297/16.2, 42, 45, 297/35, 28, 27, 41, 38, 46, 44, 51

(56) References Cited

U.S. PATENT DOCUMENTS

| | | | | | |
|---|---|---|---|---|---|
| 4,826,241 | A | * | 5/1989 | Barras | 297/16.2 |
| 5,058,950 | A | * | 10/1991 | Mann | 297/45 |
| 5,984,406 | A | * | 11/1999 | Lee | 297/45 |
| 6,082,813 | A | * | 7/2000 | Chen | 297/35 |
| 6,454,348 | B1 | * | 9/2002 | Wu | 297/35 |
| 6,550,855 | B2 | * | 4/2003 | Liu | 297/42 |

FOREIGN PATENT DOCUMENTS

| | | | | | |
|---|---|---|---|---|---|
| EP | 256837 | A | * | 2/1988 | A47C/4/48 |

* cited by examiner

*Primary Examiner*—Anthony D. Barfield
(74) *Attorney, Agent, or Firm*—Rutan & Tucker

(57) ABSTRACT

A collapsible chair (100) with solid armrests (160) has a front leg (110), a rear leg (120), a seat support rod (130), and a back support rod (140) coupled together such that the back support rod reclines independently of the seat support rod, and that the chair collapses in a single movement in which the front legs approximate each other when the front legs pivot towards the rear legs.

14 Claims, 1 Drawing Sheet

MULTI-POSITION COLLAPSIBLE BEACH CHAIR WITH SOLID ARMRESTS

FIELD OF THE INVENTION

The field of the invention is collapsible furniture.

BACKGROUND OF THE INVENTION

Folding chairs are relatively popular, in part because they can be stored with considerably reduced space requirements when compared to non-folding chairs. Nevertheless, folding chairs still require relatively large space, since the dimension of the folding chair is generally reduced only along one space coordinate (e.g., reduced length). To further reduce the space requirement, collapsible chairs have been developed, in which further size reduction is achieved by folding the chair along at least two space coordinates (e.g., length and width). Various collapsing chairs are known in the art.

In U.S. Pat. No. 5,921,621, for example, Cook et al. describes a collapsible chair with a foldable backrest, in which the chair has four legs that support the corners of a flexible square seat. The legs are movably attached to each other at about their respective midpoints, and the seat is collapsed in width and depth by turning the legs around the midpoint. While Cooks chair is relatively easy to unfold and collapse, Cooks chair provides relatively little stability and is prone to tipping over.

Improved stability can be achieved by including slidable cross bars between the legs as described in U.S. Pat. No. 6,082,813 to Chen and U.S. Pat. No. 5,984,406 to Lee. Chen's chair advantageously collapses to a relatively compact form. However, the position of the back support is limited to a vertical position, which may not be comfortable over a prolonged period. On the other hand, Lee's chair provides an angled backrest, although it lacks a seat support entirely.

In addition to the problems of the collapsible chairs mentioned above, all or almost all of the known collapsible chairs suffer from a common disadvantage in that the seat will loose tension once the seat supports the weight of a person. Moreover, where known chairs are collapsible in a single motion, such chairs do typically fail to provide a seat support rod onto which the seat can be tensioned. Alternatively, where known chairs have a pair of seat support rods, such chairs generally require at least two folding motions (e.g., one motion in which the seat is folded upwards followed by one motion in which the seat is folded in a side-to-side movement). Moreover, all or almost all known collapsible chairs fail to provide solid armrests and a backrest that can be reclined. Therefore, there is a need to provide improved methods and apparatus for collapsible chairs.

SUMMARY OF THE INVENTION

The present invention is directed to a collapsible chair with a solid armrest in which the back reclines independently of the seat. In particular, the collapsible chair has a pair of front legs, a pair of rear legs, and a pair of seat support rods. A pair of back support rods is coupled to the rear legs, a seat is coupled to the seat support rods, and a pair of solid armrests is coupled to the rear legs and the back support rods. The front legs are coupled to the seat support rods with a first pair of cross braces, the rear legs are coupled to the back support rods with a second pair of cross braces, and the back support rods recline among a plurality of predetermined positions. All elements of contemplated chairs are coupled in a manner such that the chair collapses in a single movement in which the front legs approximate each other when the front legs pivot towards the rear legs.

In one aspect of the inventive subject matter, the rear legs are slidably coupled to the seat support rods and the backrest, and the front legs are pivotally coupled to the seat support rods. It is further contemplated that the back support rods recline independent of the front legs, the rear legs, and the seat support rods, and it is especially preferred that at least one of the solid armrests is a stepped armrest and coupled to a back support rod such that the back support rod reclines in two or more fixed positions.

In another aspect of the inventive subject matter, the seat is a tensioned seat that may or may not be coupled to the backrest to form a continuous supporting surface. Especially preferred seats and backrests are fabricated from weather resistant material, and the front legs, the rear legs, the cross braces, the back support rods, and the seat support rods are preferably manufactured from aluminum. It is further contemplated that the armrest is rotatably coupled to the back support rod and engages with the rear leg in one of at least 2 different positions, wherein the different positions are determined by the solid armrest.

In a further aspect of the inventive subject matter, a method of imparting collapsibility into a chair has one step in which a pair of front legs, a pair of rear legs, and a pair of seat support rods are provided. In another step, a pair of back support rods are coupled to the rear legs, and a seat is coupled to the seat support rods, and in yet another step, a pair of solid armrests is coupled to the rear legs and/or the back support rods such that the back support rods recline among a plurality of predetermined positions. In a further step, the front legs, the rear legs, the solid armrests, the back support rods, and the seat support rods are coupled to each other such that the chair collapses in a single movement in which the front legs approximate each other when the front legs pivot towards the rear legs.

Various objects, features, aspects and advantages of the present invention will become more apparent from the following detailed description of preferred embodiments of the invention, along with the accompanying drawings, in which like numerals represent like components.

DETAILED DESCRIPTION

Figure 1:
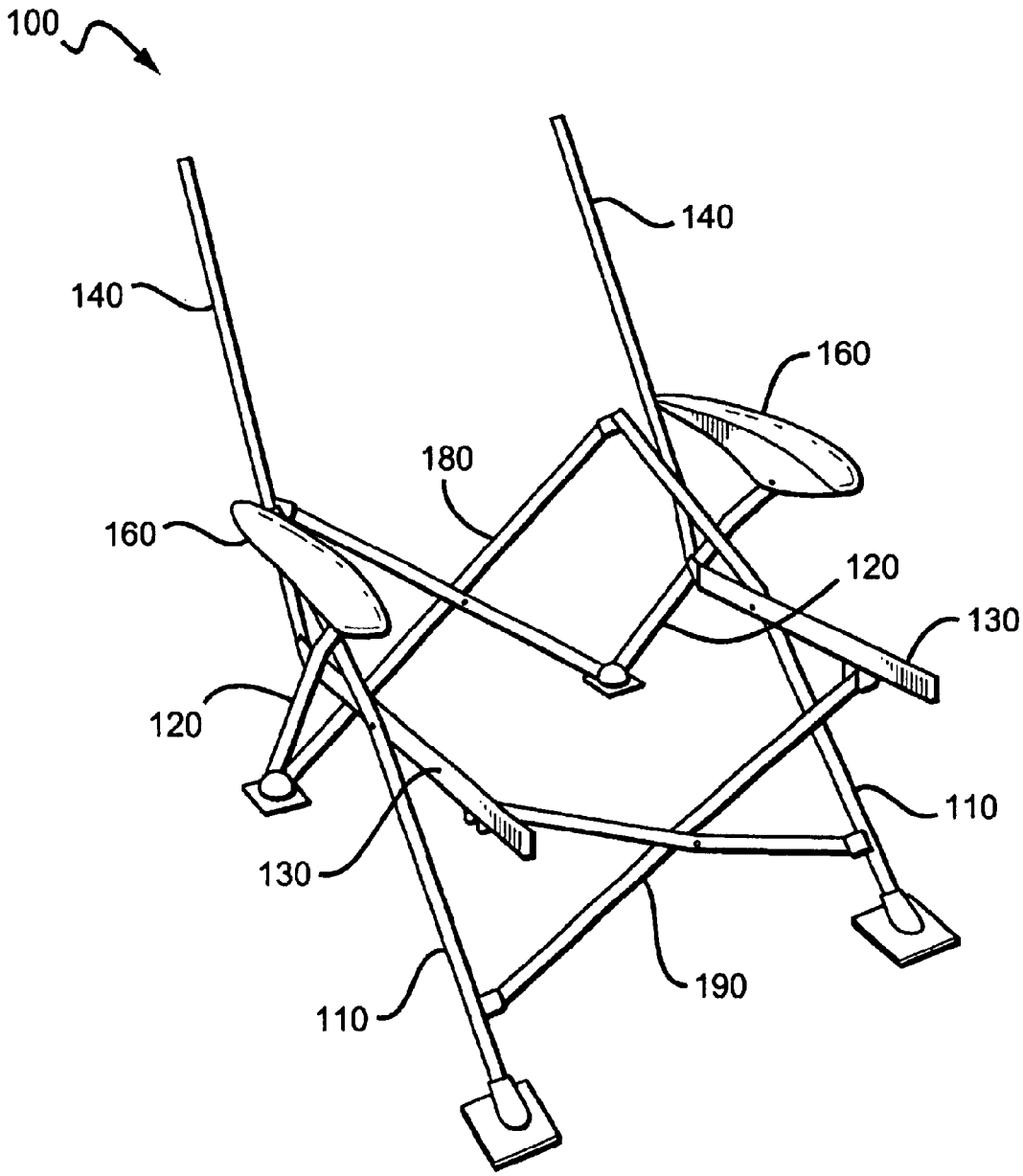
FIG. 1 is a perspective view of a collapsible chair according to the inventive subject matter.

It is generally contemplated that a collapsible chair with a solid armrest has a backrest that reclines independently from the seat, and it is further contemplated that the chair collapses in a single movement.

In a preferred configuration, as depicted in FIG. 1, a collapsible chair 100 has a pair of front legs 110 and a pair of rear legs 120. A pair of seat support rods 130, and a pair of back support rods 140 are coupled to the pair of rear legs 120. A first cross brace 190 couples the front legs 110 to the seat support rods 130, and a second cross brace 180 couples the rear legs 120 to the front legs 110. A backrest 170 (not shown) is coupled to the back support rods 140, and a seat 150 (not shown) is coupled to the seat support rods 130. The solid armrests 160 are coupled to the back support rods 140 and the rear legs 120.

In a preferred method of coupling the elements of contemplated chairs, the front legs 110 are rotatably coupled to the seat support rods 130 and the rear legs 120. The armrests 160 are rotatably coupled to the back support rods 140, and further engage with the rear legs 120 via a recess (i.e. cutout) in the armrests 160. The rear legs 120 are rotatably and slidably coupled to the seat support rods 130 and the back support rods 140. The first cross brace 190 is rotatably coupled to the front legs 110 and rotatably (and optionally sidably) coupled to the seat support rods 130, while the second cross brace 180 is rotatably coupled to the rear legs 120 and rotatably (and optionally slidably) coupled to the front legs 110.

It is contemplated that the seat and the backrest are fabricated from a weather resistant material, preferably a woven synthetic polymer (e.g., Nylon) and is uniformly colored (e.g., blue). Particularly preferred seats have a width of about 21 inches and an overall length of about 24 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the backrest it is contemplated that the backrest is fabricated from the same material as the seat, and that the backrest is removably or permanently coupled to the seat (e.g., sewed, coupled with a zipper, etc.) Thus, it is preferred that the backrest has a width of about 21 inches. A preferred height of the backrest is about 18 inches. With respect to the material and color, it is contemplated that the same considerations as for the seat apply. It is further contemplated that the width and height of suitable backrests may vary, and that width and height will depend among other things on the person's size and the number of persons to be seated in the chair. Thus, alternative backrests may have a width between 18–12 inches and less, but also between 18–22 and more. Similarly, contemplated backrests may have a height between 12–18 inches and less, but also between 18–25 inches and more.

It is generally contemplated that the seat and the backrest may be coupled to the legs and seat support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadbly securable elements (e.g., laces threaded through rings). Permanent couplings include sewed or glued elements. For example, the backrest may permanently coupled to the chair via a rivet. On the other hand, the front end of the seat may be temporarily coupled to the front legs via ring-shaped openings that are slid over the top ends of the front legs. It is further, particularly preferred that the seat and the backrest are coupled together to form a continuous supporting surface.

It should further be appreciated that the attachment of the seat and/or the backrest to the chair may be directly or indirectly attached. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the seat support rods via a slidable pouch. Alternatively, the seat may be indirectly coupled to the seat support rods via a ring-shaped opening in the seat that slidably engages with the rods.

With respect to the legs, seat support rods, and cross braces of contemplated chairs, it should be appreciated that all of such elements may be manufactured from various materials, including metals, metal alloys, natural and synthetic polymers, and any reasonable combination thereof. However, it is preferred that the legs, seat support rods, and cross braces are manufactured from black anodized aluminum tubing with a wall strength of about 1/32 inch and an outer diameter of approximately ½ inch. Preferred alternative materials include stainless steel, fiberglass, and wood.

Where one of the legs, back support rods, seat support rods, or cross braces is pivotally coupled to another one of the legs, back support rods, seat support rods, or cross braces, it is generally contemplated that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Especially contemplated rotatable couplings further include additional coupling elements that may or may not operate in a function other than rotatably coupling. For example, the second cross brace and the front legs may be rotatably coupled to an element that also operates as a base plate that contacts the ground when the chair is in the extended configuration. Similarly, where one of the legs, back support rods, seat support rods, or cross braces is slidably coupled to another one of the legs, seat support rods, and cross braces, all known slidable couplings are contemplated to be appropriate, and include a sliding sleeve, slide rails, guiding rings, etc.

In a preferred aspect, a collapsible chair has two front legs, two rear legs, and two seat support rods, and two back support rods, wherein a first cross brace couples the front legs to the seat support rods, and a second cross brace couples the rear legs to the back support rods. It is particularly preferred, that all of the front legs, rear legs, back support rods, and seat support rods are coupled through the cross braces in a manner that allows collapsing the chair in a single movement, i.e., that the front legs approximate each other, when the rear legs pivot towards the front legs (side-to-side and concurrent front-to-back movement). In preferred configurations, the armrests and the seat support rods pivot downwardly and the front legs move apart, when the chair is unfolded in an extended configuration. As viewed from another perspective, it is preferred that the seat and armrests fold upwards when the front legs approximate.

In alternative aspects, various couplings other than rotatable and slidable couplings are also contemplated, and particularly contemplated alternative couplings include telescoping couplings, combined telescoping and sliding couplings, combined telescoping and rotating couplings, foldable elements (i.e., front legs, rear legs, seat support rods, back support rods, cross braces, and armrests), and elements including flexible portions to accommodate for a change in configuration or angle relative to other elements. It is further generally preferred that at least one of the front legs extends upwardly beyond the seat support rods and/or the rear leg, however, in alternative configurations, an additional element may couple the second cross brace to at least one of the rear legs, the front legs, and the seat support rods.

With respect to the configuration of contemplated chairs, it should be recognized that numerous alternative configurations are also appropriate, so long as alternative collapsible chairs collapse in a single movement, and so long as the backrest or back support rods recline independently from the seat or seat support rods. The term "backrest or back support rods recline independently from the seat or seat support rods" means that the backrest or back support rods recline from a first position to a second position while angle and/or lateral position of the seat or seat support rods relative to the front and rear legs remain substantially constant. For example, in some alternative configurations, a cross brace may be slidably coupled to the front legs and rotatably coupled to the seat support rods. In other alternative configurations, the armrests may be coupled to the seat support rods.

It should be especially appreciated that in contemplated configurations of collapsible chairs, the seat is tensioned when the front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the seat support rod is no more than one 1 inch, more preferably no more than 0.5 inch, and most preferably no more than 0.25 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the seat support rod increases no more than 1.5 inches, preferably no more than 0.75 inch, more preferably no more than 0.5 inch, and most preferably no more than 0.25 inch. Thus, it should be especially appreciated that the tension of the seat is predominantly determined by the firmness of the material of the seat.

While not whishing to be bound by a particular theory, it is contemplated that the tension in the seat remains substantially tensioned due to mechanically coupling an approximating movement of the seat support rods with a simultaneous movement of at least one of the rear legs relative to the front leg and a movement of the front legs relative to each other. Viewed from another perspective, it should be recognized that while all or almost all of the prior art chairs with a seat support rod require at least two separate folding operations to collapse the chair, contemplated collapsing chairs are folded in a single movement (comparably to the collapsing of an umbrella). Moreover, it should be recognized that contemplated modes of coupling the front leg with the rear leg and the seat support rod prevent loss of tension of the seat when a person is supported by the chair.

With respect to the armrest, it is generally preferred (but not limiting to the inventive subject matter) that the armrest is a solid armrest. As used herein, the term "solid armrest" means that the armrest is fabricated from a sufficiently stiff material to substantially maintain the shape of the armrest while the chair is being folded or unfolded. The term "substantially maintain the shape" as used herein means that the shape of the armrest is deformed no more than 20%, preferably no more than 10% and even more preferably no more than 5% in any dimension (i.e., length, width, or thickness). For example, a wooden or metal armrest is considered a solid armrest under the scope of this definition, because such armrests are fabricated from a material with sufficient stiffness to maintain the shape of the armrest. In contrast, a woven or textile armrest is not considered a solid armrest under the scope of this definition because such armrests will deform (i.e. change their shape) while the chair is folded or unfolded.

It is particularly preferred that the armrest is coupled to the rear leg via a cutout in the armrest through which a bolt extends, wherein the bolt is attached to the rear leg. In even more preferred aspects of the inventive subject matter, the cutout in the solid armrest is shaped such that the bolt (or other structure extending from the rear leg through the cutout) can engage with the cutout in various predetermined positions. Consequently, it should be appreciated that where contemplated armrests are rotatably coupled to the back support rod, the inclination of the backrest/back support rods may be changed among a plurality of predetermined positions. Such predetermined positions may be fixed predetermined positions where the cutout provides multiple bays with which the bolt from the rear leg can engage (the armrest is then a stepped armrest). Alternatively, the predetermined positions may be variable where the cutout provides a channel in which the bolt from the rear leg can move among an infinite number of positions (and thus provides an infinite number of reclining degrees for the back support rods). Where the cutout is a channel, it is especially contemplated that the bolt has an additional lock through which the relative position of the armrest to the rear leg can be secured.

Thus, a method of imparting collapsibility into a chair has one step in which a pair of front legs, a pair of rear legs, and a pair of seat support rods are provided. In another step, a pair of back support rods is coupled to the rear legs, and a seat is coupled to the seat support rods. In yet another step, a first cross brace is coupled to the front legs and the seat support rods, while a second cross brace is coupled to the rear legs and the front legs. In a still further step, a pair of solid armrests are coupled to at least one of the rear legs and the back support rods such that the back support rods recline among a plurality of predetermined positions, and all elements are coupled such that the chair collapses in a single movement in which the front legs approximate each other when the front legs pivot towards the rear legs.

It should be recognized that such coupling may be realized in various configurations. For example, the front leg on one side of the chair may be coupled to the seat support rod on the other side of the chair via a cross brace, wherein the cross brace is on one end rotatably coupled to the front leg, and on the other end rotatably and slidably coupled to the seat support rod. Furthermore, each of the seat support rods may be rotatably and slidably coupled to the respective rear legs. In particularly preferred methods, the armrest (preferably a solid armrest) is rotatably coupled to the back support rod and engages with the rear leg in one of at least 2 different positions, wherein the at least 2 different positions are determined by one or more cutouts in the solid armrest. In further particularly contemplated aspects, the rear leg is slidingly coupled to a seat support rod and a back support rod, and the front leg is rotatably coupled to the rear leg and the seat support rod.

It should further be appreciated that in alternative aspects of the inventive subject matter the number of legs, and/or seat supports may vary considerably. For example, where the chair is sized and dimensioned to accommodate more than one person, three, four, or more legs, and/or seat supports may be included. On the other hand, where stability of the seat is particularly desirable, three or more seat support rods may be included in a chair with two front legs and two rear legs. Likewise, the number of cross braces may vary, and while some chairs may have only one pair of cross braces, other chairs may include three, four, or more cross braces.

In still further alternative aspects of the inventive subject matter, the second cross brace may also be coupled to an element that couples the cross brace to the front leg and/or the rear leg. Moreover, it should be appreciated that the coupling may very depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via an intermediate rod, that rotatably couples two elements together.

Thus, specific embodiments and applications of multi-position collapsible beach chairs with solid armrests have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a pair of front legs, a pair of rear legs, and a pair of seat support rods;

a pair of back support rods coupled to the rear legs, and a seat coupled to the seat support rods, wherein the front legs are coupled to the seat support rods with a first cross brace, and wherein the rear legs are coupled to the front legs with a second cross brace;

a pair of solid armrests coupled to at least one of the rear legs and the back support rods, wherein the back support rods recline among a plurality of predetermined positions; and wherein the front legs, the rear legs, the solid armrests, the back support rods, the cross braces and the seat support rods are coupled in a manner such that the chair collapses in a single movement in which the front legs approximate each other when the front legs pivot towards the rear legs, and when the seat support rods and the solid armrests pivot towards the backrest.

2. The collapsible chair of claim 1 wherein at least one of the rear legs is sidably coupled to the seat support rods and the backrest.

3. The collapsible chair of claim 1 wherein at least one of the front legs is pivotally coupled to the seat support rods.

4. The collapsible chair of claim 1 wherein at least one of the solid armrests is a stepped armrest and coupled to at least one of the back support rods and to at least one of the rear legs such that the back support rods recline in at least two fixed positions.

5. The collapsible chair of claim 1 wherein the back support rods recline independent of the front legs, the rear legs, and the seat support rods.

6. The collapsible chair of claim 1 wherein at least one of the front legs, the rear legs, the cross braces, the back support rods, and the seat support rods are manufactured from aluminum.

7. The collapsible chair of claim 1 wherein the seat is a tensioned seat.

8. The collapsible chair of claim 1 further comprising a backrest, and wherein the seat and the backrest are coupled together to form a continuous supporting surface.

9. The collapsible chair of claim 1 wherein the seat and the backrest are manufactured from a weather resistant material.

10. A method of imparting collapsibility into a chair, comprising:

providing a pair of front legs, a pair of rear legs, and a pair of seat support rods;

coupling a pair of back support rods to the rear legs, coupling a seat to the seat support rods, coupling a first cross brace to the front legs and the seat support rods, and coupling a second cross brace to the rear legs and the front legs;

coupling a pair of solid armrests to at least one of the rear legs and the back support rods such that the back support rods recline among a plurality of predetermined positions, and such that the chair collapses in a single movement in which the front legs approximate each other when the front legs pivot towards the rear legs.

11. The method of claim 10 wherein the armrests are rotatably coupled to the back support rods and engage with the rear legs in one of at least 2 different positions.

12. The method of claim 11 wherein the at least two positions are determined by a plurality of cutouts in the armrests.

13. The method of claim 10 wherein the rear legs are slidingly coupled to the seat support rods and the back support rods.

14. The method of claim 10 wherein the front legs are rotatably coupled to the rear legs and the seat support rods.

* * * * *